US009713877B2

(12) United States Patent
Mintz et al.

(10) Patent No.: US 9,713,877 B2
(45) Date of Patent: Jul. 25, 2017

(54) CLIPPER HEAD WITH DRAG REDUCTION

(71) Applicant: Medline Industries, Inc., Mundelein, IL (US)

(72) Inventors: Stuart Mintz, Glenview, IL (US); Robert Lockwood, Libertyville, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 14/539,891

(22) Filed: Nov. 12, 2014

(65) Prior Publication Data

US 2016/0129602 A1 May 12, 2016

(51) Int. Cl.
*B26B 19/02* (2006.01)
*B26B 19/38* (2006.01)

(52) U.S. Cl.
CPC ..... *B26B 19/3846* (2013.01); *B26B 19/3813* (2013.01); *B26B 19/3853* (2013.01)

(58) Field of Classification Search
CPC ..... B26D 19/3813; B26D 19/3846; B26B 19/3873; B26B 19/386; B26B 19/388; B26B 19/3853
USPC ..... 30/208, 224, 233.5
See application file for complete search history.

(56) References Cited

U.S. PATENT DOCUMENTS 1,908,385 A 5/1933 Wahl
2,291,439 A * 7/1942 Andis ..... B26B 19/06 30/123
2,822,742 A 6/1954 Ochs et al.
3,747,212 A 7/1973 Krayl
3,986,258 A * 10/1976 Liedtke ..... B26B 21/08 30/233.5
3,999,295 A 12/1976 Du Bois
4,249,307 A 2/1981 Andis
4,380,869 A 4/1983 Shirakawa et al.
4,430,794 A 2/1984 Miller
4,458,417 A 7/1984 Andis
4,563,814 A 1/1986 Trichell
4,700,476 A 10/1987 Locke et al.
4,765,060 A 8/1988 Veselaski et al.
4,825,546 A 5/1989 Araki et al.
4,899,444 A 2/1990 Trichell et al.
5,054,199 A 10/1991 Ogawa et al.
(Continued)

FOREIGN PATENT DOCUMENTS

CN 100544906 9/2009
GB 20039 0/1897
(Continued)

OTHER PUBLICATIONS

"Notice of Allowance", U.S. Appl. No. 29/508,975, filed Nov. 12. 2014; Mailed Oct. 7, 2016.
(Continued)

*Primary Examiner* — Omar Flores Sanchez
(74) *Attorney, Agent, or Firm* — Philip H. Burrus, IV

(57) ABSTRACT

A clipper head (100) includes a base surface (102) and a front surface (204). One or more clipper teeth (109) extend from an intersection (108) of the base surface and the front surface. One or more protuberances (110,111,112) extend from the base surface. The protuberances reduce the surface area that contacts a patient's skin, thereby reducing friction and drag.

12 Claims, 9 Drawing Sheets

(56) References Cited

U.S. PATENT DOCUMENTS 5,068,966 A 12/1991 Wahl et al.
5,108,409 A 4/1992 Demeester
5,159,256 A 10/1992 Mattinger et al.
5,185,931 A 2/1993 Fujikawa et al.
5,211,648 A 5/1993 Demeester
5,251,375 A 10/1993 Crucq et al.
5,306,285 A 4/1994 Miller et al.
5,325,589 A 7/1994 Kubo
5,367,772 A 11/1994 Ogawa
5,550,452 A 8/1996 Shirai et al.
5,557,850 A 9/1996 Mun
5,575,069 A 11/1996 Kneeland
5,579,581 A 12/1996 Melton
5,600,890 A 2/1997 Leitner et al.
5,606,799 A 3/1997 Melton
5,715,601 A 2/1998 Nakatani et al.
5,802,932 A 9/1998 Vankov et al.
5,933,964 A 8/1999 Altamore
5,970,616 A 10/1999 Wahl et al.
5,983,499 A 11/1999 Andrews
D423,720 S 4/2000 Nielsen et al.
6,073,348 A 6/2000 Shiba
6,073,350 A 6/2000 Elston et al.
6,082,005 A 7/2000 Tezuka
6,098,288 A 8/2000 Miyagawa et al.
6,112,414 A 9/2000 Andis
6,125,542 A 10/2000 Somma
6,139,562 A 10/2000 Mauze
D436,229 S 1/2001 Eguchi et al.
6,223,438 B1 5/2001 Parsonage et al.
6,263,576 B1 7/2001 Drapak et al.
6,276,060 B1 8/2001 Faulstich et al.
6,277,129 B1 8/2001 Poran
6,322,569 B1 11/2001 Sueyoshi et al.
6,367,533 B1 4/2002 Pitzen
6,421,922 B2 7/2002 Beutel et al.
6,427,337 B1 8/2002 Burks
6,490,798 B2 12/2002 Morisugi et al.
6,490,799 B2 12/2002 Eich et al.
6,502,312 B2 1/2003 Beutel et al.
6,505,403 B1 1/2003 Andrews
6,505,404 B2 1/2003 Ullmann
6,536,116 B2 3/2003 Fung
6,637,113 B2 10/2003 Ikuta et al.
6,658,740 B2 12/2003 Habben
6,666,875 B1 12/2003 Sakurai et al.
6,669,704 B2 12/2003 Inoue et al.
6,684,507 B2 2/2004 Lau et al.
6,684,511 B2 2/2004 McCambridge et al.
6,742,262 B2 6/2004 Rizzuto et al.
6,862,810 B2 3/2005 Braun et al.
6,886,255 B2 5/2005 Freas et al.
6,901,664 B2 6/2005 Melton et al.
6,966,116 B2 11/2005 Peter et al.
6,973,855 B2 12/2005 Yanosaka et al.
6,986,206 B2 1/2006 McCambridge et al.
7,001,410 B2 2/2006 Fisher et al.
7,010,859 B2 3/2006 Laube
7,017,270 B2 3/2006 Shiba et al.
7,080,458 B2 7/2006 Andis
7,114,257 B1 10/2006 Ortega
D535,786 S 1/2007 Gianninin et al.
7,234,242 B2 6/2007 Yao
7,249,416 B2 7/2007 Yamaguchi et al.
7,263,388 B2 8/2007 Yamamoto
7,281,461 B2 10/2007 McCambridge et al.
D558,399 S 12/2007 Seki et al.
7,340,839 B2 3/2008 Oh
7,346,990 B2 3/2008 Dirks et al.
D567,444 S 4/2008 Giannini
D567,446 S 4/2008 Hara et al.
D577,864 S 9/2008 Kitagawa et al.
7,419,494 B2 9/2008 Hashiguchi et al.
D583,098 S 12/2008 Giannini
7,464,471 B2 12/2008 Fukutani et al.
7,509,926 B2 3/2009 Porter et al.
7,536,789 B2 5/2009 Michel
7,536,790 B2 5/2009 Ebenhoch
D602,636 S 10/2009 Lother et al.
7,624,506 B2 12/2009 Melton et al.
7,631,673 B2 12/2009 Salovaara
7,637,014 B2 12/2009 Schnak et al.
7,703,210 B2 4/2010 Lau
7,733,058 B2 6/2010 Takaoka et al.
7,748,123 B2 7/2010 Bednar
7,762,001 B2 7/2010 Morisugi et al.
D624,244 S 9/2010 Giannini
7,832,104 B2 11/2010 Yamasaki et al.
7,841,091 B2 11/2010 Melton
7,845,132 B2 12/2010 Morton
7,872,445 B2 1/2011 Hui
7,877,880 B2 2/2011 Royle
7,913,399 B2 3/2011 Lau
7,921,566 B2 4/2011 Yamaguchi et al.
7,937,837 B2 5/2011 Psimadas et al.
7,952,322 B2 5/2011 Partovi et al.
7,954,243 B2 6/2011 De Wit et al.
D697,266 S 1/2014 Zheng et al.
D697,668 S 1/2014 Zheng et al.
D697,669 S 1/2014 Zheng et al.
D697,670 S 1/2014 Zheng et al.
D697,671 S 1/2014 Zheng et al.
D698,079 S 1/2014 Zheng
D698,086 S 1/2014 Zheng et al.
D698,493 S 1/2014 Zheng et al.
D698,494 S 1/2014 Zheng et al.
D711,045 S 8/2014 Palmer et al.
D711,594 S 8/2014 Palmer et al.
D733,357 S 6/2015 Palmer et al.
D733,358 S 6/2015 Palmer et al.
D733,964 S 7/2015 Palmer et al.
D734,543 S 7/2015 Mintz et al.
D734,544 S 7/2015 Mintz et al.
2003/0145469 A1 8/2003 Ogawa et al.
2003/0204956 A1 11/2003 Chan
2004/0049921 A1 3/2004 Freas et al.
2006/0042096 A1 3/2006 Liao
2006/0156549 A1 7/2006 O
2006/0184063 A1 8/2006 Miller
2006/0230621 A1 10/2006 Liao
2006/0265880 A1 11/2006 Sagawa
2007/0022607 A1 2/2007 Takeuchi et al.
2007/0044320 A1 3/2007 Fukutani et al.
2007/0044604 A1 3/2007 Andis et al.
2007/0209211 A1 9/2007 Pragt et al.
2007/0213742 A1 9/2007 Callahan
2007/0214654 A1 9/2007 Chen et al.
2007/0289138 A1 12/2007 Worgull
2007/0289144 A1 12/2007 Morisugi et al.
2008/0005906 A1 1/2008 Franke et al.
2008/0052915 A1 3/2008 Fukutani et al.
2008/0134516 A1 6/2008 Morisugi et al.
2008/0155834 A1 7/2008 Li et al.
2008/0209741 A1 9/2008 Chen et al.
2008/0216324 A1 9/2008 Tauer
2008/0235956 A1 10/2008 Molis et al.
2008/0263871 A1 10/2008 Liao
2008/0276460 A1 11/2008 Yanosaka et al.
2008/0282550 A1 11/2008 Piwaron
2008/0295340 A1 12/2008 Carlucci et al.
2008/0301948 A1 12/2008 Kostner et al.
2009/0019706 A1* 1/2009 Werner ..... B26B 19/3813 30/233.5
2009/0056137 A1 3/2009 Royle
2009/0056143 A1 3/2009 Fukutani et al.
2009/0106981 A1 4/2009 Palmer et al.
2009/0113722 A1* 5/2009 Werner ..... B26B 19/3813 30/200
2009/0119928 A1 5/2009 Lee
2009/0119932 A1 5/2009 Lau
2009/0158596 A1 6/2009 Ouchi et al.
2009/0293698 A1 12/2009 Tran
2009/0307909 A1 12/2009 Sato et al.
2009/0320296 A1 12/2009 Morisugi et al.

(56) References Cited

U.S. PATENT DOCUMENTS

| | | | |
|---|---|---|---|
| 2010/0057100 | A1 | 3/2010 | Zeevi |
| 2010/0083508 | A1 | 4/2010 | Cheng |
| 2010/0085017 | A1 | 4/2010 | Heeringa et al. |
| 2010/0126022 | A1 | 5/2010 | Shiba et al. |
| 2010/0162568 | A1 | 7/2010 | Kawaguchi |
| 2010/0180446 | A1 | 7/2010 | Shimizu et al. |
| 2010/0180448 | A1 | 7/2010 | Sato et al. |
| 2010/0194337 | A1 | 8/2010 | Opolka |
| 2010/0217263 | A1 | 8/2010 | Tukulj-Popovic |
| 2010/0229396 | A1 | 9/2010 | Bednar |
| 2010/0299927 | A1 | 12/2010 | Fischer |
| 2010/0299930 | A1 | 12/2010 | Voorhorst et al. |
| 2010/0325893 | A1 | 12/2010 | Komori et al. |
| 2011/0006611 | A1 | 1/2011 | Baarman et al. |
| 2011/0010942 | A1 | 1/2011 | Lau |
| 2011/0010943 | A1 | 1/2011 | Izumi |
| 2011/0016727 | A1 | 1/2011 | Fuerst et al. |
| 2011/0036058 | A1 | 2/2011 | Howdeshell et al. |
| 2011/0061241 | A1 | 3/2011 | Jian |
| 2011/0082494 | A1 | 4/2011 | Kerr et al. |
| 2011/0119930 | A1 | 5/2011 | Scheunert |
| 2011/0131790 | A1 | 6/2011 | Chien |
| 2011/0167639 | A1 | 7/2011 | Lau et al. |
| 2011/0196404 | A1 | 8/2011 | Dietz et al. |
| 2012/0233865 | A1 | 9/2012 | Kammer |
| 2012/0233866 | A1 | 9/2012 | Kammer |
| 2013/0219724 | A1 | 8/2013 | Werner |
| 2015/0246454 | A1 | 9/2015 | Mintz et al. |

FOREIGN PATENT DOCUMENTS

| | | | | |
|---|---|---|---|---|
| JP | D1314637 | | 10/2007 | |
| WO | WO 2005108021 | A1 * | 11/2005 | ..... B26B 19/20 |

OTHER PUBLICATIONS

Rivard, Jennifer "Final OA", U.S. Appl. No. 29/508,975, filed Nov. 12, 2014; Mailed Feb. 24, 2016.

Rivard, Jennifer "NonFinal OA", U.S. Appl. No. 29/508,975, filed Nov. 12, 2014; Mailed Sep. 29, 2015.

Rivard, Jennifer "Notice of Allowance", U.S. Appl. No. 29/508,975, filed Nov. 12, 2014; Mailed Jun. 9, 2016.

* cited by examiner

CLIPPER HEAD WITH DRAG REDUCTION

BACKGROUND

Technical Field

This disclosure relates generally to clippers, trimmers, or shavers, and more particularly to a head for a clipper, trimmer, or shaver.

Background Art

In medical procedures, razors and clippers are frequently used to remove a patient's hair about the surgical site prior to the procedure. Many medical personnel prefer to have all hair removed prior to the procedure. While disposable razors are useful in accomplishing this, many medical professionals have discontinued their use due to the fact that such razors can cause nicks, cuts, bumps, or other skin irritation. This irritation can result in post-operative infection in some instances. In other instances, the reddened and irritated skin can complicate the procedure. For this reason, most medical professionals today prefer to use electric clippers for hair removal.

While electrical clippers are effective at removing hair quickly, they are not as efficient as a manual razor. Conventional electrical clippers may require many passes through the patient's hair to successfully remove enough of the hair for the procedure. Additionally, conventional clippers can cause static electrical fields that cause clipped hair to remain on the surgical site, which increases potential for contamination and the clipper, which in turn would increase cleaning and disinfecting time. It would be advantageous to have an improved clipper head.

Figure 1:
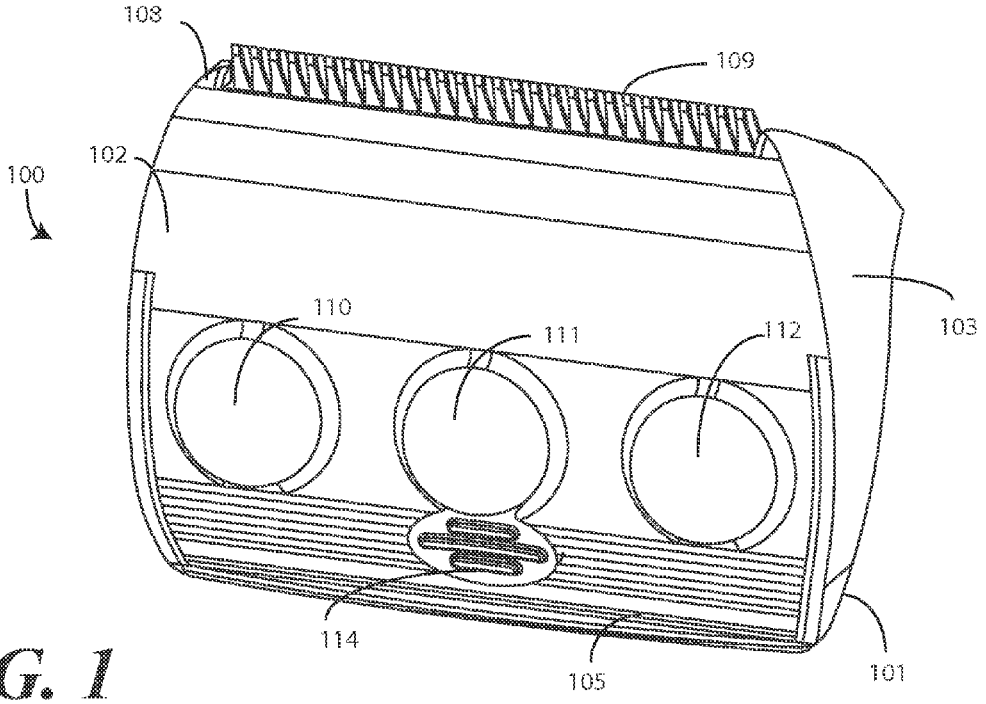
FIG. 1 illustrates a perspective view of one explanatory clipper head in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a clipper head that is suitable for use with an electronic clipper. In one embodiment, the clipper head comprises a base surface and a front surface. The front surface and the base surface can extend from an intersection, which defines an edge of the clipper head in one or more embodiments. One or more clipper teeth can extend from the intersection of the base surface and the front surface.

In one embodiment, one or more protuberances can be disposed along the base surface. The one or more protuberances can, in one embodiment, work to reduce the surface area of the base surface that contacts a patient's skin when the clipper head is in use. For example, in one embodiment the base surface defines a base surface area and the one or more protuberances define a protuberance surface area that is less than the base surface area. This functions to reduce friction to reduce drag and effort needed to push the one or more clipper teeth through a patient's hair.

In one embodiment, the protuberances are disposed distally from the intersection of the base surface and the front surface. For example, in one embodiment at least fifty percent of the base surface area disposed between the intersection and the one or more protuberances. This causes the rear edge of the clipper head to be biased upward and away from a patient's skin when the clipper head is in use. This causes the one or more clipper teeth to extend toward the patient's skin, thereby ensuring a more efficient and closer trim that requires fewer passes with less effort to achieve the desired clipped result. The closer cut offered by the protuberances allows for a more unrestricted view of the surgical site that will assist the medical professional performing the subsequent surgical procedure.

Advantageously, the inclusion of the one or more protuberances also reduces the amount of static charge generated when the clipper head passes along a patient's skin. This reduction in static charge results in less clipped hair sticking to the patient, the clipper attached to the clipper head, or the clipper head itself, which in turn results in reduced cleaning resulting from clipper head usage. Advantageously, clipper assemblies using clipper heads configured in accordance with one or more embodiments of the disclosure last longer and require less maintenance.

In one or more embodiments, the one or more protuberances comprise three protuberances. The three protuberances can be configured as partial spherical surfaces, although other shapes will be obvious to those of ordinary skill in the art having the benefit of this disclosure. In one embodiment, the protuberances can each be define a hemispherical surface. In addition to providing the advantages noted above, the inclusion of the one or more protuberances can serve as a mnemonic device identifying which surface of the clipper head is the base surface and should be placed against the patient's skin. The protrusions therefore ensure that a user has a visually intuitive indication of which side of the clipper head to place against a person's skin.

Figure 2:
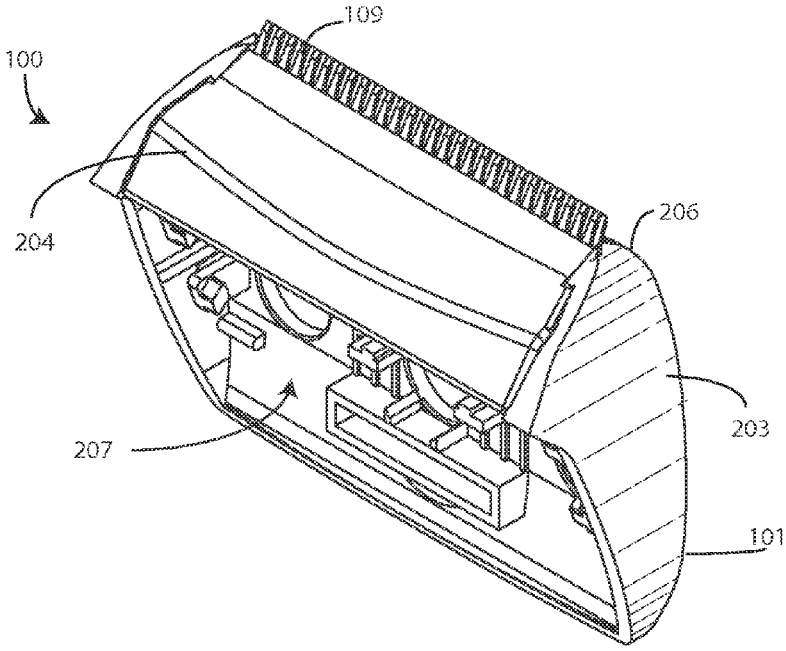
FIG. 2 illustrates another perspective view of one explanatory clipper head in accordance with one or more embodiments of the disclosure.
Figure 3:
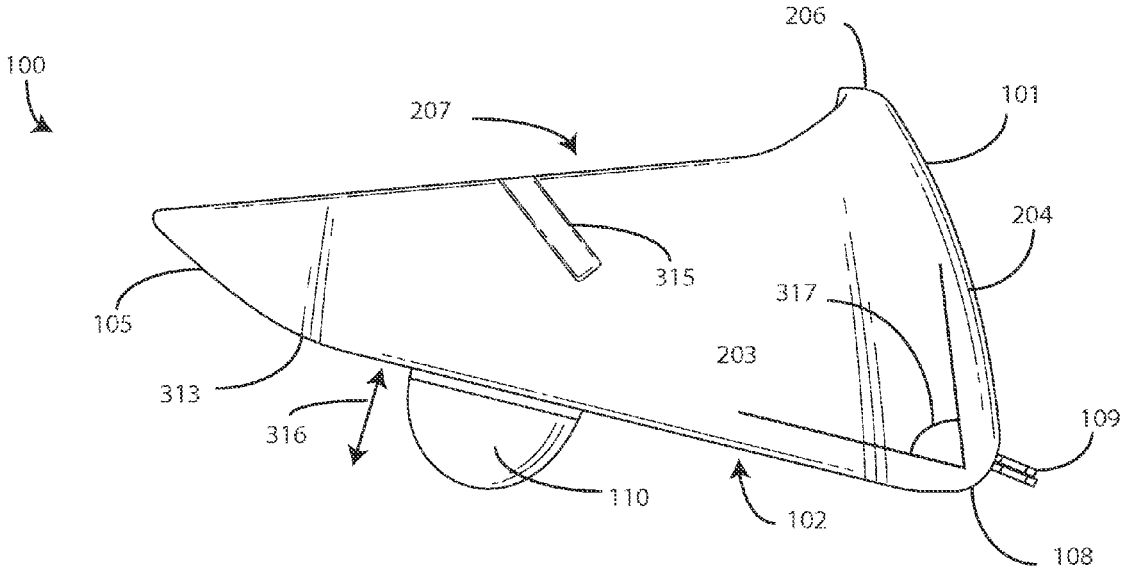
FIG. 3 illustrates a front elevation view of one explanatory clipper head in accordance with one or more embodiments of the disclosure.
Figure 4:
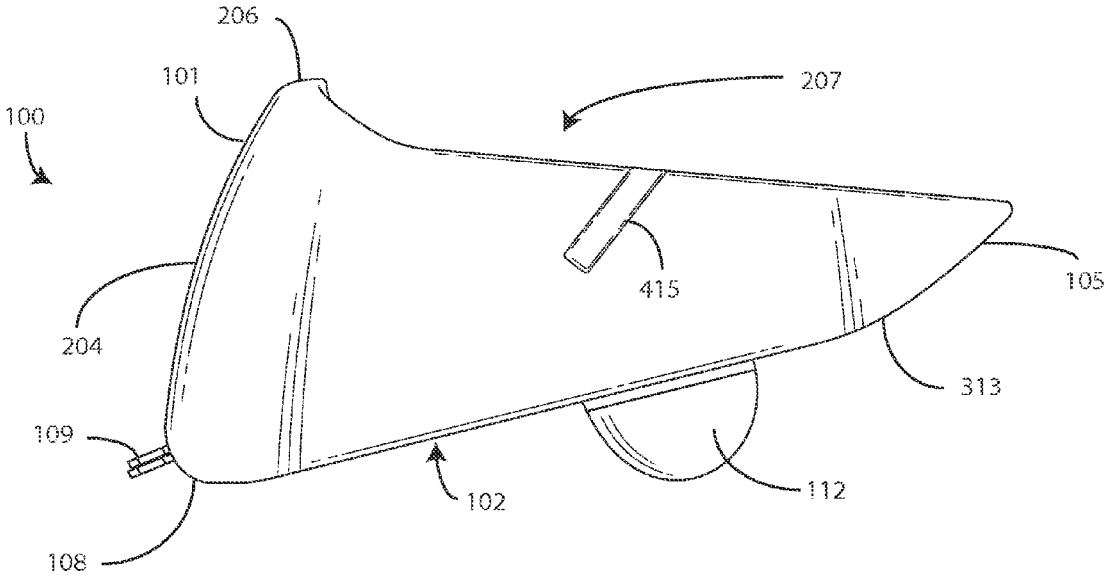
FIG. 4 illustrates a rear elevation view of one explanatory clipper head in accordance with one or more embodiments of the disclosure.
Figure 5:
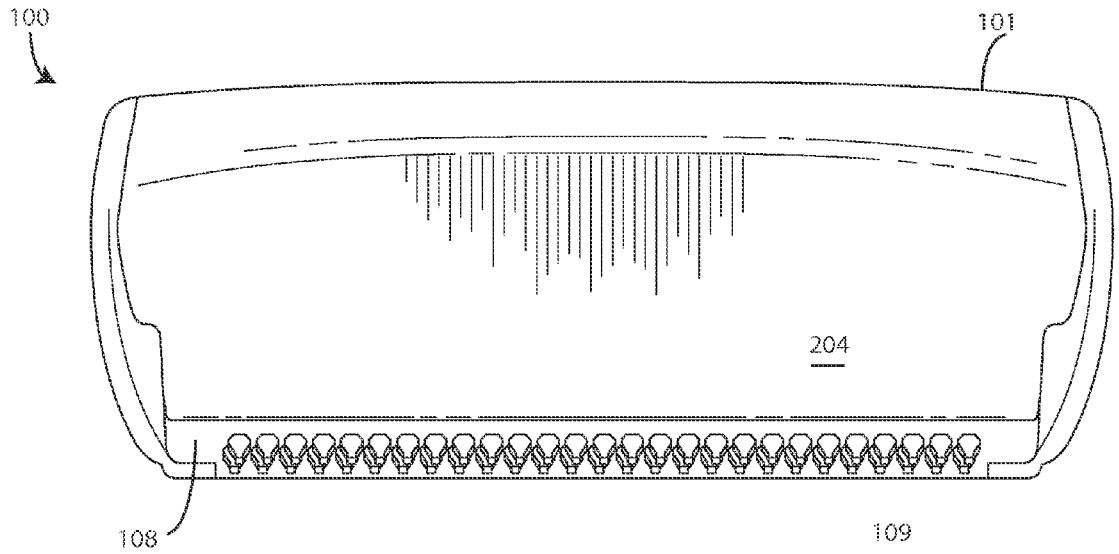
FIG. 5 illustrates a right elevation view of one explanatory clipper head in accordance with one or more embodiments of the disclosure.
Figure 6:
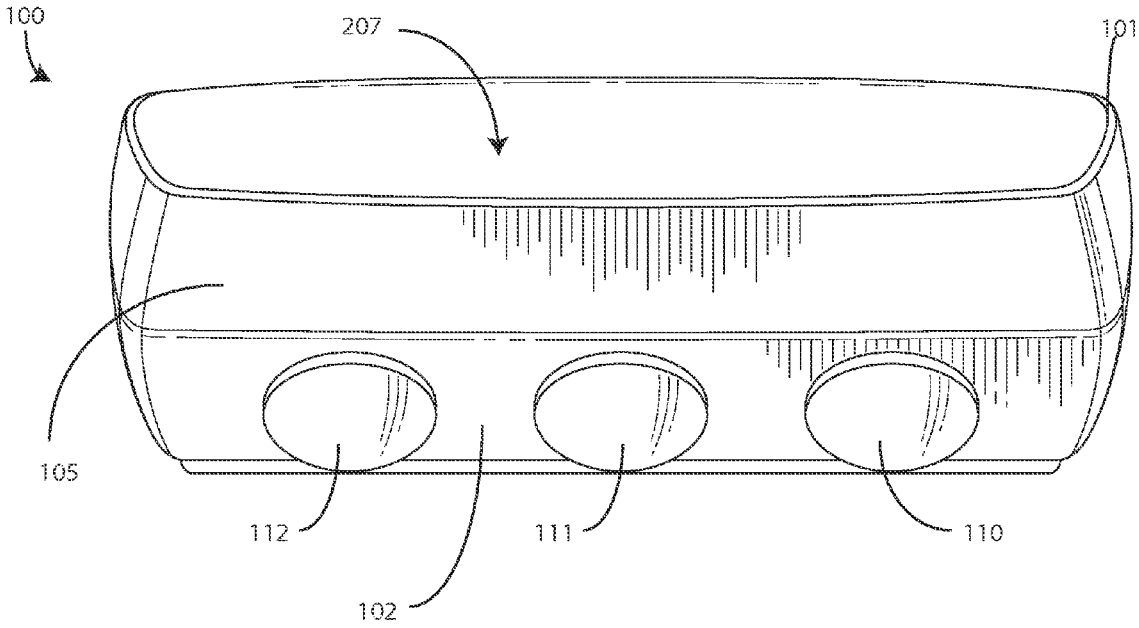
FIG. 6 illustrates a left elevation view of one explanatory clipper head in accordance with one or more embodiments of the disclosure.
Figure 7:
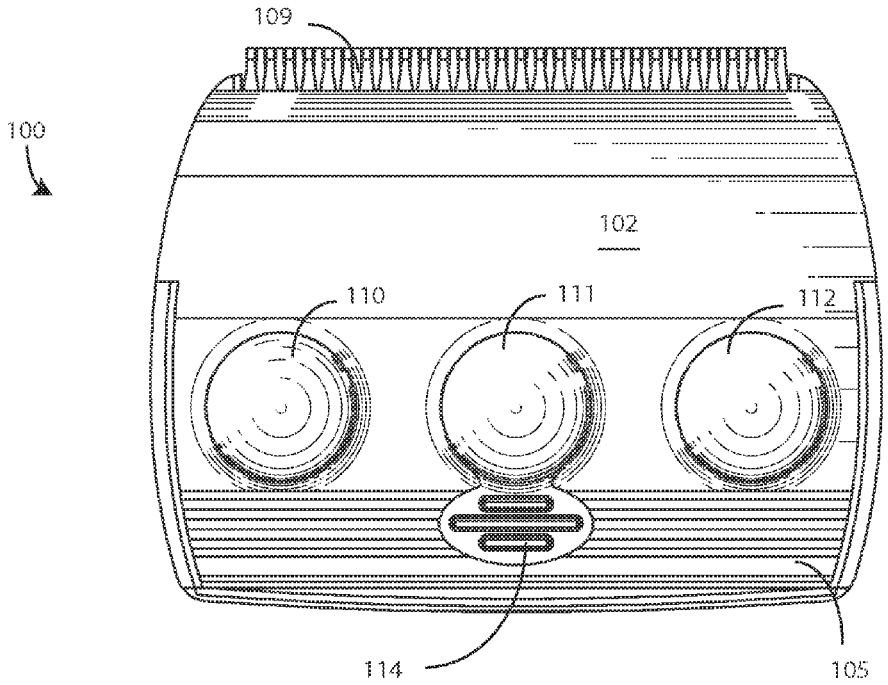
FIG. 7 illustrates a bottom plan view of one explanatory clipper head in accordance with one or more embodiments of the disclosure.
Figure 8:
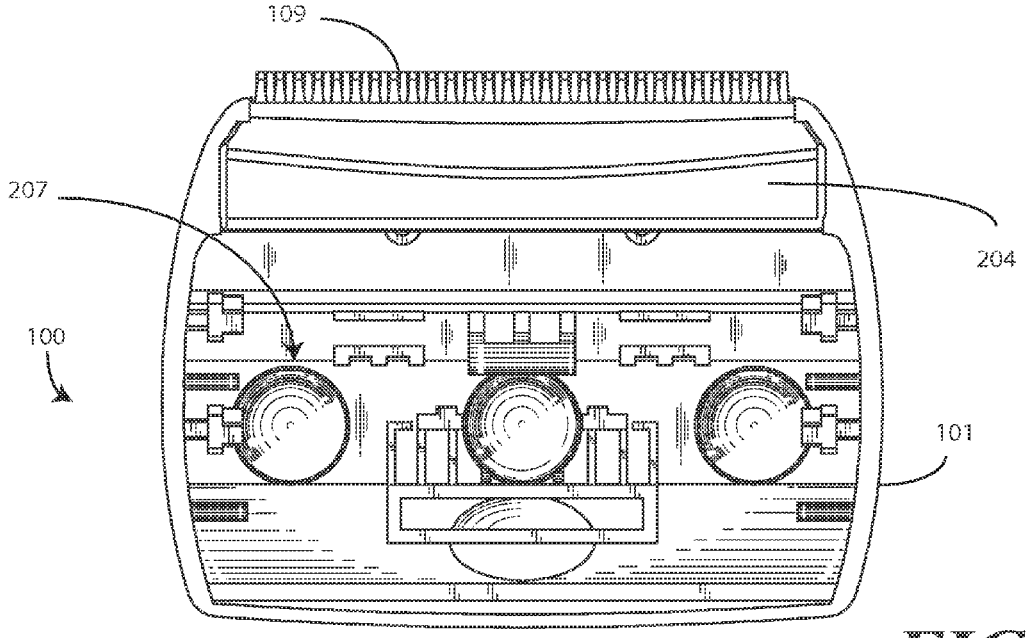
FIG. 8 illustrates a top plan view of one explanatory clipper head in accordance with one or more embodiments of the disclosure.

Turning now to FIGS. 1-8, illustrated therein is one explanatory clipper head 100 configured in accordance with one or more embodiments of the disclosure. FIGS. 1-2 illustrate perspective views, while FIGS. 3-4 illustrate side elevation views. FIGS. 5-6 illustrate front and rear elevation views, respectively, while FIGS. 7-8 illustrate bottom and top plan views, respectively.

The clipper head 100 can be selectively attachable to, and detachable from, an electric clipper body in one or more embodiments. One or more mechanical features, snaps, releases, or other attachment features (not shown) can allow the clipper head 100 to be attached to the clipper body. Making the clipper head 100 selectively attachable to a clipper body facilitates ease of cleaning in one or more embodiments. However, embodiments of the disclosure are not so limited. In other embodiments, the clipper head 100 can be integrated with an electric clipper such that the electric clipper and the clipper head 100 are manufactured as a unitary device.

In one embodiment, the clipper head 100 includes a housing 101. The housing 101 can define one or more surfaces of the clipper head 100. The housing 101 can also define other features, such as a thumb recess 114, clipper engagement features 315,415, and so forth.

In one embodiment, the housing 101 can be manufactured from a rigid material, such as a thermoplastic resin. The housing 101 can be manufactured by an injection molding process. For example, in one embodiment the housing 101 is formed by injecting a first material, such as a thermoplastic like polycarbonate, into an injection mold cavity. Accordingly, the housing 101 in one embodiment is formed as a unitary, singular component in one or more embodiments.

In one embodiment, the material used to manufacture the housing 101 must be capable of being sterilized prior to packaging. In one embodiment, the clipper head 100 is used to trim a user's hair prior to surgical procedures being performed. Accordingly, the clipper head 100 may need to be sterilized prior to use. Examples of materials suitable for sterilization without compromising reliability of the clipper head 100 include polycarbonate, ABS, and nylon. Other such materials will be obvious to those of ordinary skill in the art having the benefit of this disclosure.

In one embodiment, the material used to manufacture the housing 101 is static-charge resistant. For example, in one embodiment the material includes electrically conductive materials. The material can be impregnated with metal, metal fibers, or other conductive materials to reduce the chance that a static charge will develop when the housing 101 is passed along a patient's skin during use. In another embodiment, the material can be coated with conductive materials, such as metallized film coatings and so forth. This reduction in static charge works to reduce the amount of clipped hair that statically clings to a surgical site, thereby reducing potential for contamination of the surgical site.

In one embodiment, the housing 101 defines several surfaces. For example, in the illustrative embodiment of FIGS. 1-8, the housing 101 includes a base surface 102, one or more side surfaces 103,203, a front surface 204, and an optional trailing surface 105. The illustrative contours shown in FIGS. 1-8 are illustrative only, as others will be readily apparent to those of ordinary skill in the art having the benefit of this disclosure.

In one embodiment, the base surface 102 and the front surface 204 intersect at an intersection 108. The intersection 108 can define a corner in one or more embodiments. In the illustrative embodiment of FIGS. 1-8, the intersection 108 defines a rounded edge. In one embodiment, the base surface 102 and the front surface 204 extend from the intersection 108 to define an acute angle 317. A top surface 206 can define an aperture 207 into which a clipper can be inserted to attach the clipper to the clipper head 100.

In one embodiment, one or more clipper teeth 109 extend from the intersection 108 of the base surface 102 and the front surface 204. The one or more clipper teeth 109 form a reciprocating blade assembly in one embodiment that oscillate back and forth to cut hair or other objects. The one or more clipper teeth 109 can be mechanically connected to features disposed within the aperture 207 such that the one or more clipper teeth 109 can be mechanically connected to a motor disposed within an electric clipper. When a user actuates a power button on the electric clipper, an electric motor disposed within the clipper can drive the one or more clipper teeth 109, thereby causing them to reciprocate to cut the hair of a patient.

In one embodiment, to reduce friction and drag, as well as electrostatic charge, one or more protuberances 110,111,112 can be disposed along the base surface 102. The one or more protuberances 110,111,112 extend distally from the base surface 102 at least a predetermined distance 316 in one or more embodiments. For example, in one embodiment the one or more protuberances 110,111,112 extend from the base surface 102 by a distance 316 of at least two millimeters.

The one or more protuberances 110,111,112 can be integrally formed with the base surface 102 in one embodiment. For example, the one or more protuberances 110,111,112 can be integrally formed with the housing 101 using an injection molding process in one embodiment. In other embodiments, the one or more protuberances 110,111,112 are detachable. Detachability offers the advantage of being able to attach different protuberances of different sizes in one or more embodiments.

Figure 10:
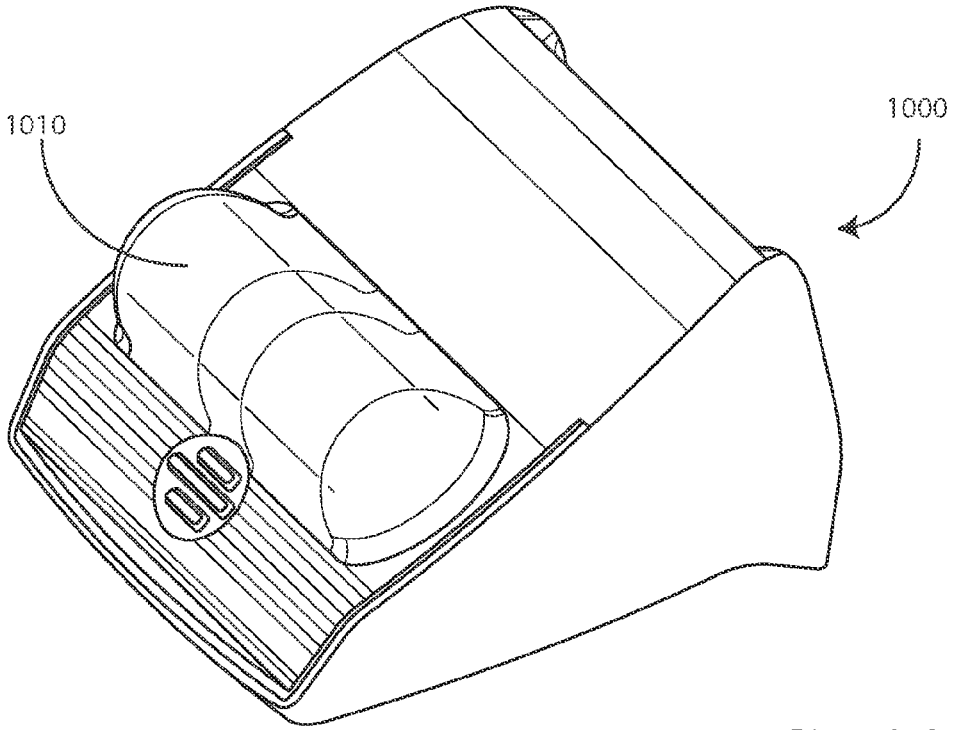
FIG. 10 illustrates a perspective view of another explanatory clipper head in accordance with one or more embodiments of the disclosure.
Figure 11:
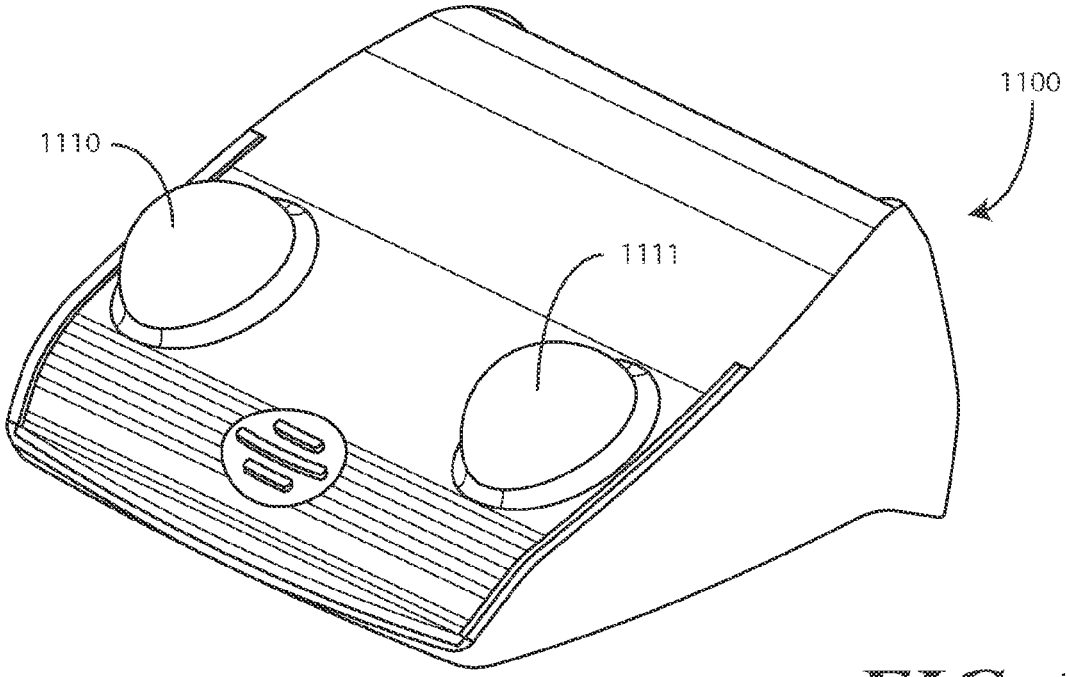
FIG. 11 illustrates a perspective view of another explanatory clipper head in accordance with one or more embodiments of the disclosure.
Figure 12:
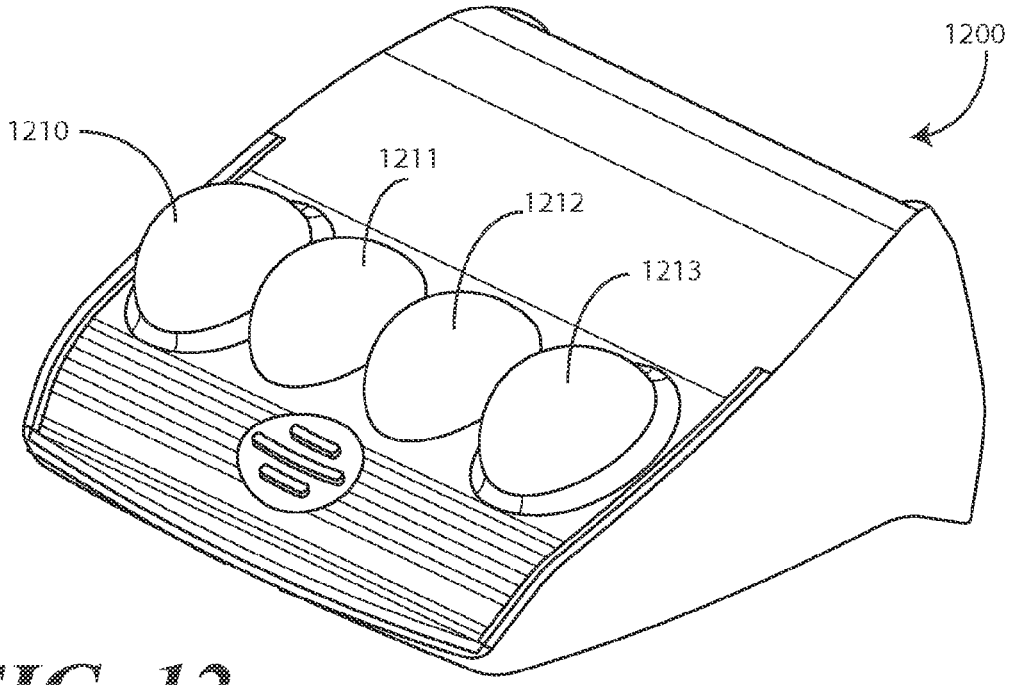
FIG. 12 illustrates a perspective view of another explanatory clipper head in accordance with one or more embodiments of the disclosure.

In the illustrative embodiment of FIGS. 1-8, the one or more protuberances 110,111,112 comprise a plurality of protuberances. In this illustrative embodiment, there are only three protuberances 110,111,112, with each configured as a partial spherical surface. However, in other embodiments there can be more than three protuberances or less than three protuberances. For example, turning briefly to FIG. 10, illustrated therein is a clipper head 1000 having a single protuberance 1010. Turning to FIG. 11, illustrated therein is a clipper head 1100 with two protuberances 1110,1111. Turning to FIG. 12, illustrated therein is a clipper head 1200 with four protuberances 1210,1211,1212,1213. Other numbers of protuberances, as well as locations of protuberances, will be obvious to those of ordinary skill in the art having the benefit of this disclosure.

Turning now back to FIGS. 1-8, the rounded shape of the partial spherical surface works to reduce the amount of surface area contacting a patient's skin when the clipper head 100 is in use. In the embodiment of FIGS. 1-8, the use of three partial spherical protuberances 110,111,112 reduces the amount of surface area contacting a patient's skin. Said differently, where the base surface 102 defines a base surface area, and the three partial spherical protuberances 110,111, 112 define a protuberance surface area, in one embodiment the protuberance surface area is less than the base surface area. Advantageously, the partial spherical surface reduces the amount of drag and effort needed to push the clipper head 100 through hair while the one or more clipper teeth 109 are cutting. Since clipping becomes more efficient, fewer passes are required to obtain an acceptable cut.

The inclusion of the one or more protuberances 110,111, 112 offers other advantages as well. In one embodiment, the one or more protuberances define a mnemonic device identifying which surface of the clipper head 100 is the base surface 102. A user can simply look at the protuberances 110,111,112 to quickly identify the fact that the side with the protuberances 110,111,112, i.e., the base surface 102, is to contact a user's skin. Accordingly, the protuberances 110, 111,112 provide an intuitive clipper head orientation to a user.

As will be shown in more detail in FIG. 9 below, in one embodiment the protuberances raise the rear of the base surface 102, which lowers the one or more clipper teeth 109 so as to be closer to a user's skin. This, in turn, provides a closer cut. A closer cut provides a more unrestricted view of a surgical site, which benefits a surgeon operating on a site trimmed with the clipper head 100.

In one or more embodiments, the inclusion of the one or more protuberances 110,111,112 also help to reduce the amount of static that accumulates on the housing 101 by reducing the amount of surface area of the housing 101 that frictionally engages a user's skin during the cutting process. This reduction in static electricity works to reduce the amount of hair that statically clings to the housing 101, which reduces cleaning, disinfecting, and maintenance requirements for the clipper head 100.

As noted, in this illustrative embodiment the one or more protuberances 110,111,112 define partial spherical surfaces. It will be obvious to those of ordinary skill in the art having the benefit of this disclosure that the protuberances 110,111, 112 could take other shapes as well. For example, in another embodiment the one or more protuberances 110,111,112 define hemispherical surface. In another embodiment, the one or more protuberances 110,111,112 define a partial ovular surface. In another embodiment, the one or more protuberances 110,111,112 define a partial parabolic surface.

Figure 13:
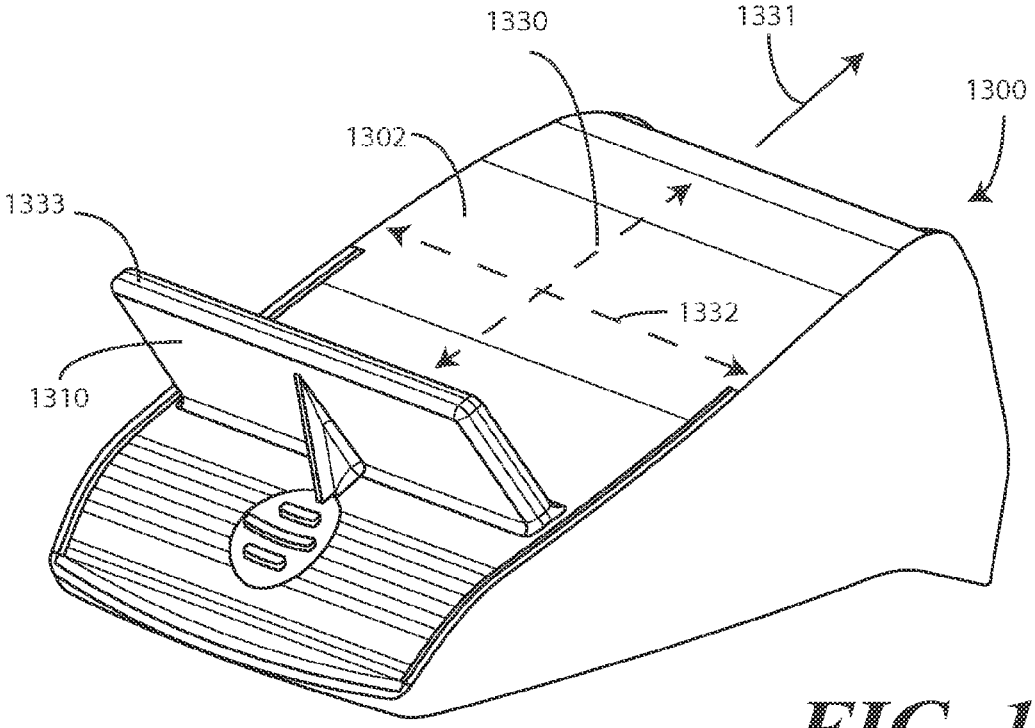
FIG. 13 illustrates a perspective view of another explanatory clipper head in accordance with one or more embodiments of the disclosure.

A few alternate protuberance shapes are illustrated in FIGS. 13-16. Turning briefly to FIG. 13, illustrated therein is a clipper head 1300 with a singular protuberance 1310 configured as an orthogonal flange. The protuberance 1310 is referred to as an "orthogonal flange" because it is oriented substantially perpendicular with a major dimension 1330 of the base surface 1302 that is oriented substantially parallel with the direction of motion 1331 when the clipper head 1300 is in use. The orthogonal flange extends distally from the base surface 1302 at a substantially orthogonal angle in this embodiment. Note that the terms "about" or "substantially" refer to an alignment or dimension inclusive of manufacturing tolerances. Thus, a "substantially orthogonal" angle with a manufacturing tolerance of plus or minus 0.5 degrees would include any angle between 89.5 degrees and 90.5 degrees, inclusive.

In FIG. 13, the orthogonal flange extends substantially all of the width 1332 of the clipper head 1300. However, it could be shorter—or even longer in other embodiments. The orthogonal flange of this illustrative embodiment terminates in a curved edge 1333 so as to provide similar advantages to the rounded surfaces of the protuberances (110,111,112) of the embodiment of FIGS. 1-8.

Figure 14:
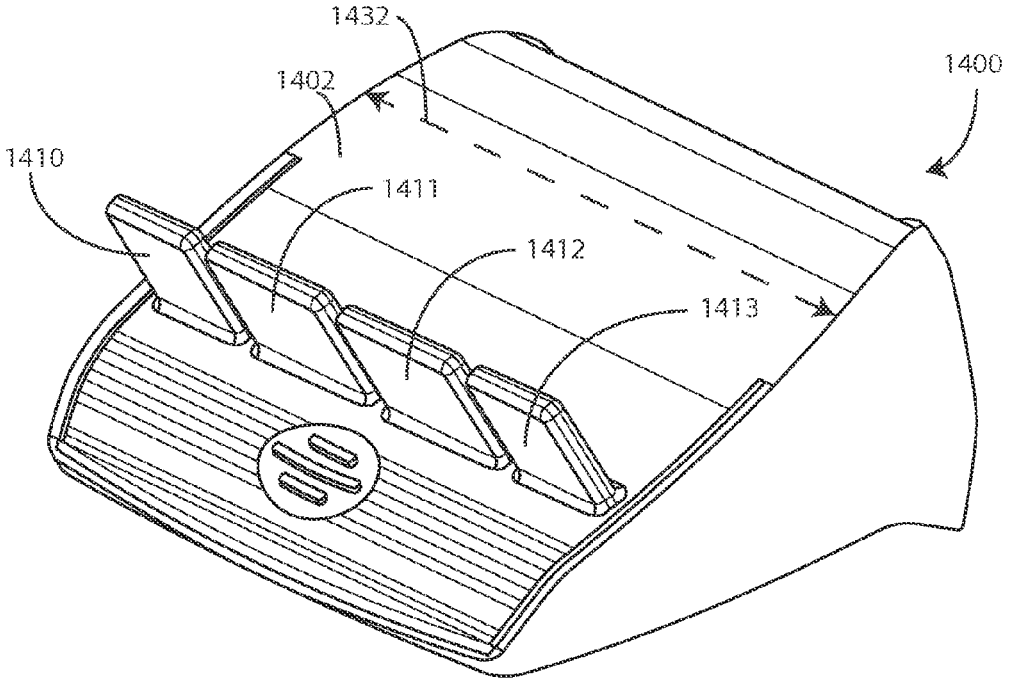
FIG. 14 illustrates a perspective view of another explanatory clipper head in accordance with one or more embodiments of the disclosure.

Turning briefly to FIG. 14, illustrated therein is another clipper head 1400 in accordance with one or more embodiments of the disclosure. In FIG. 14, the clipper head 1400 includes four protuberances 1410,1411,1412,1413, each being configured as an orthogonal flange. In FIG. 14, each orthogonal flange extends along only a portion of the width 1432 of the clipper head 1400. In this illustrative embodiment, each of the four protuberances 1410,1411,1412,1413 has a common height and is arranged in a single lone across the base surface 1402 of the clipper head 1400. However, the four protuberances 1410,1411,1412,1413 could be staggered in a non-linear arrangement along the base surface 1402 of the clipper head 1400 as well. In such an embodiment, one or more of the four protuberances 1410,1411,1412,1413 may have a height that is different from another of the four protuberances 1410,1411,1412,1413.

Figure 15:
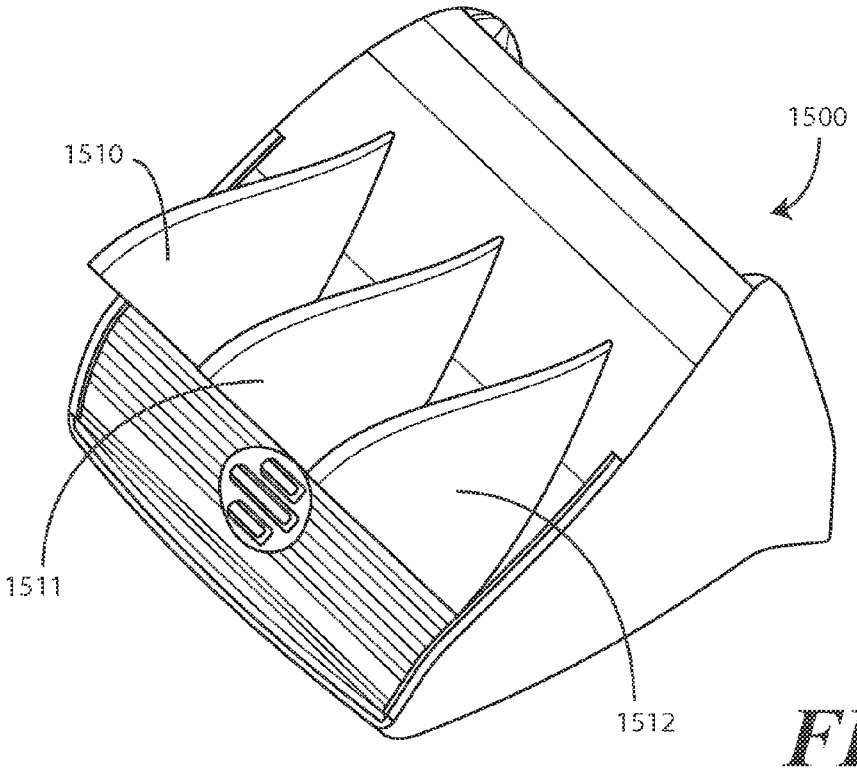
FIG. 15 illustrates a perspective view of another explanatory clipper head in accordance with one or more embodiments of the disclosure.

Turning briefly to FIG. 15, illustrated therein is another clipper head 1500 comprising one or more protuberances 1510,1511,1512. The protuberances 1510,1511,1512 of FIG. 15 have a shark-fin appearance and are oriented substantially parallel with a major dimension 1530 of the base surface 1502 that is oriented substantially parallel with the direction of motion 1531 when the clipper head 1500 is in use. In FIG. 15, three protuberances 1510,1511,1512 are shown. However, as with previous embodiments, more or fewer than three protuberances 1510,1511,1512 can be used as well.

Figure 16:
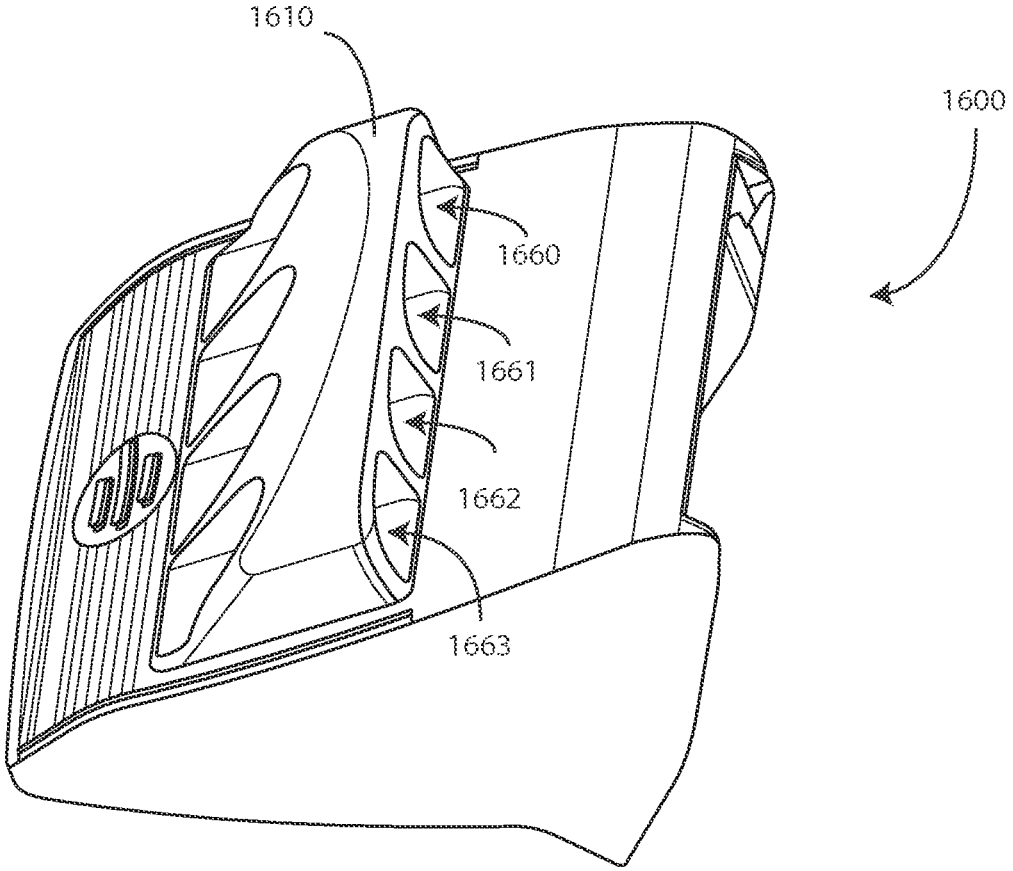
FIG. 16 illustrates a perspective view of another explanatory clipper head in accordance with one or more embodiments of the disclosure.

Turning briefly to FIG. 16, illustrated therein is yet another clipper head 1600 configured in accordance with one or more embodiments of the disclosure. In FIG. 16, as with FIGS. 10 and 13, the clipper head 1600 comprises a singular protuberance 1610 extending from the base surface 1602 of the clipper head 1600. The protuberance 1610 includes a plurality of apertures 1660,1661,1662,1663 that allow clipped hair or other debris to pass therethrough during the cutting process. The embodiments of FIGS. 10-16 are illustrations of some of the many embodiments in which clipper heads in accordance with one or more embodiments of the disclosure can be configured. Still others will be obvious to those of ordinary skill in the art having the benefit of this disclosure.

Turning now back to FIGS. 1-8, and as best shown in FIGS. 3 and 4, the one or more protuberances 110,111,112 raise the trailing edge 313 of the base surface 102. Accordingly, when the clipper head 100 rests on a substantially flat surface, the one or more protuberances 110,111,112 cause the one or more clipper teeth 109 to project toward the surface. Thus, when the clipper head 100 rests such that the intersection 108 and the one or more protuberances 110,111, 112 are against a patient's skin, the one or more clipper teeth 109 are closer to the skin to provide a closer cut.

In one embodiment, the one or more protuberances 110, 111,112 are disposed distally across the base surface 102 from the intersection 108 of the base surface 102 and the front surface 204. In one embodiment, at least fifty percent of the base surface area of the base surface 102 is disposed between the intersection 108 and the one or more protuberances 110,111,112. As best shown in FIGS. 1 and 7, in one embodiment the one or more protuberances 110,111,112 are disposed between the intersection 108 and the thumb recess 114.

Figure 9:
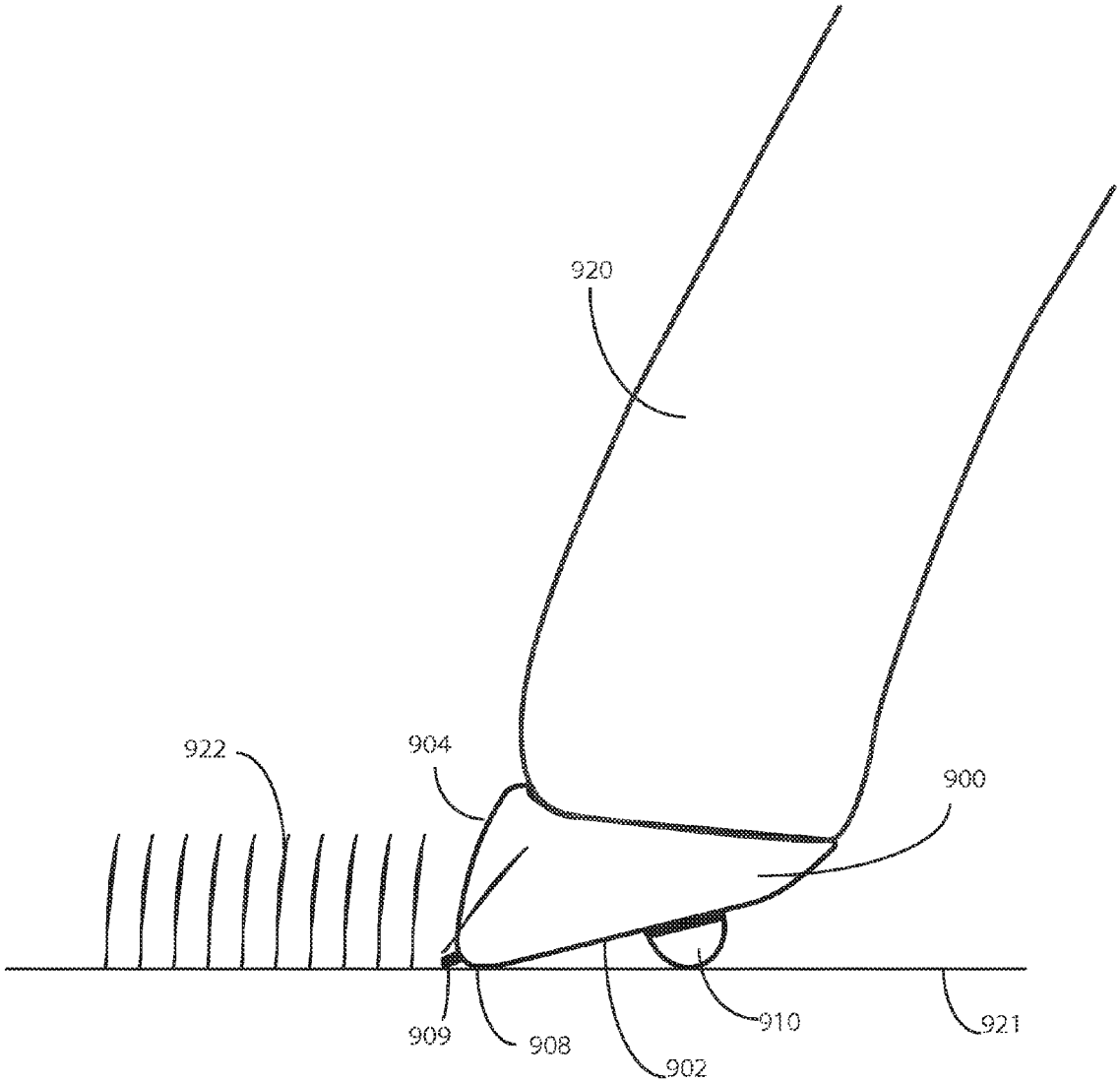
FIG. 9 illustrates one explanatory clipper head in use.

Turning now to FIG. 9, illustrated therein is an explanatory clipper head 900 configured in accordance with one or more embodiments of the disclosure. The clipper head 900 has been attached to an electric clipper 920 and is being passed along a surface 921, which in this example is a patient's skin. One or more clipper teeth 909 are being used to clip a patient's hair 922. As shown in FIG. 9, the one or more clipper teeth 909 extend from the edge 908 toward the surface 921.

The clipper head 900 includes a first surface 902 and a second surface 904. The first surface 902 and the second surface 904 intersect to define an edge 908 of the clipper head 900. One or more protuberances 910 are disposed along, and extend from, the first surface 902. Note that if the convention was reversed, and the first surface 902 and second surface 904 were reversed, the one or more protuberances 910 would extend from the second surface 904. As noted above, relational terms such as first and second, top and bottom, and the like may be used solely to distinguish one entity or action from another entity or action without necessarily requiring or implying any actual such relationship or order between such entities or actions.

In this embodiment, each protuberance 910 is configured as a rounded protuberance. The protuberances 910 have less surface area than does the first surface 902, thereby reducing friction as the clipper head 900 passes along the surface 921. This reduction in friction results in a lessened potential for skin abrasion and irritation during the cutting process. There are only three protuberances 910 in this embodiment. However, other embodiments could include more, or fewer, protuberances as desired for a particular application or clipper head size. For example, a small clipper head may only have one protuberance, while a larger clipper head may have four or more protuberances.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A clipper head, comprising:
a base surface and a front surface;
one or more clipper teeth extending from an intersection of the base surface and the front surface; and
one or more protuberances disposed along the base surface;
the base surface defining a base surface area with at least fifty percent of the base surface area disposed between the intersection and the one or more protuberances.

2. The clipper head of claim 1, the one or more protuberances defining a protuberance surface area, the protuberance surface area less than the base surface area.

3. The clipper head of claim 2, each protuberance defining a partial spherical surface.

4. The clipper head of claim 2, each protuberance reducing an amount of static accumulating on the clipper head.

5. The clipper head of claim 2, each protuberance integrally formed with the base surface.

6. The clipper head of claim 1, the one or more protuberances detachable from the base surface.

7. The clipper head of claim 1, the one or more protuberances comprising only three protuberances.

8. The clipper head of claim 1, the one or more protuberances defining a mnemonic device identifying which surface of the clipper head is the base surface.

9. The clipper head of claim 1, wherein when the clipper head rests on a substantially flat surface, the one or more protuberances to cause the one or more clipper teeth to project from the intersection toward the substantially flat surface.

10. The clipper head of claim 1, further comprising a thumb recess, the one or more protuberances disposed between the intersection and the thumb recess.

11. The clipper head of claim 1, the base surface and the front surface extending from the intersection at an acute angle.

12. The clipper head of claim 1, the one or more protuberances extending from the base surface by at least two millimeters.

* * * * *